US006386696B1

(12) United States Patent
Rodi et al.

(10) Patent No.: US 6,386,696 B1
(45) Date of Patent: May 14, 2002

(54) METHOD AND DEVICE FOR TRANSFERRING PRINTING INK

(75) Inventors: Anton Rodi, Karlsruher Strasse 12, D-69181 Leimen; Norbert Freyer, Sandhausen; Hans Klingel, Möglingen, all of (DE)

(73) Assignee: Anton Rodi, Leimen (DE)

( * ) Notice: Subject to any disclaimer, the term of this patent is extended or adjusted under 35 U.S.C. 154(b) by 0 days.

(21) Appl. No.: 08/699,459

(22) Filed: Aug. 19, 1996

(30) Foreign Application Priority Data

Aug. 17, 1995 (DE) ..... 195 30 284

(51) Int. Cl.[7] ..... B41J 2/01; B41J 2/325
(52) U.S. Cl. ..... 347/103; 347/213
(58) Field of Search ..... 347/103, 102, 347/51, 213, 199, 264; 399/308, 302

(56) References Cited

U.S. PATENT DOCUMENTS

| | | | | |
|---|---|---|---|---|
| 3,893,761 A | | 7/1975 | Buchan et al. | |
| 4,462,035 A | * | 7/1984 | Koto | 347/199 |
| 4,470,055 A | * | 9/1984 | Todoh | 347/199 X |
| 5,110,702 A | * | 5/1992 | Ng et al. | 430/99 |
| 5,138,389 A | * | 8/1992 | Randall | 399/302 |
| 5,150,161 A | | 9/1992 | Bujese | |
| 5,233,397 A | | 8/1993 | Till | |
| 5,444,465 A | * | 8/1995 | Ikeda | 347/213 |
| 5,502,476 A | * | 3/1996 | Neal et al. | 347/103 |
| 5,623,296 A | * | 4/1997 | Fujino | 347/103 |
| 5,636,349 A | * | 6/1997 | Landa | 399/308 X |

FOREIGN PATENT DOCUMENTS

| | | | | |
|---|---|---|---|---|
| EP | 0 297 721 A1 | | 1/1989 | |
| JP | 62-92849 | * | 4/1987 | B41J/3/04 |
| JP | 1-133746 | * | 5/1989 | B41J/3/04 |
| JP | 402099341 A | * | 4/1990 | 347/140 |
| JP | 3-284948 | * | 12/1991 | B41J/2/01 |
| JP | 4-99629 | * | 3/1992 | B41J/2/015 |
| JP | 5-318714 | * | 12/1993 | B41J/2/01 |

OTHER PUBLICATIONS

Patent Abstracts of Japan No. 08083003 (Masahiro et al.), dated Mar. 26, 1996.
Patent Abstracts of Japan No. 05006114 (Kazushi et al.), dated Jan. 14, 1993.
Patent Abstracts of Japan No. 05046035 (Toshio), dated Feb. 26, 1993.
Patent Abstracts of Japan No. 01031181 A.
Patent Abstracts of Japan No. 08083003 (Masahiro et al.), dated Mar. 26, 1996.
"Offset Quality Electrophotography" (Schein et al.), IS&T, 1993, pp. 451–461.
"Check Technology shows Delphax Engine", the Seybold Report on Publishing Systems, pp. 19–20.

* cited by examiner

*Primary Examiner*—John Barlow
*Assistant Examiner*—An H. Do
(74) *Attorney, Agent, or Firm*—Laurence A. Greenberg; Werner H. Stemer; Gregory L. Mayback

(57) ABSTRACT

A method of transferring printing ink from an intermediate carrier to a printing-ink receiver selected from the group consisting of a further intermediate carrier and a substrate, wherein the printing ink adheres either in a granular state or in an at least partially liquid state to the intermediate carrier includes, with respect to the first-mentioned state of the printing ink, melting the printing ink at a side thereof facing away from the intermediate carrier before transferring the printing ink to the printing-ink receiver and, with respect to the second-mentioned state of the printing ink, reducing the adhesion of the printing ink to the intermediate carrier with a separating agent at one time at least before and during transfer to the printing-ink receiver; and a device for performing the method.

13 Claims, 7 Drawing Sheets

65
64
60
61
63
62

METHOD AND DEVICE FOR TRANSFERRING PRINTING INK

BACKGROUND OF THE INVENTION

Field of the Invention

The invention relates to a method for transferring solid or liquid printing ink from an intermediate carrier, such as a transfer cylinder, to a further intermediate carrier or a substrate, such as paper, as well as to a device for performing the method.

In order to be able to transfer liquid printing ink from a cylinder of a printing press onto a further cylinder and a substrate, respectively, the adhesion of the printing ink to the second cylinder or the substrate, a characteristic which is based upon physical interfacial effects, must be greater than the adhesion thereof to the original cylinder. Upon the transfer of liquid ink, however, a cracking or splitting of the liquid film occurs, so that a portion thereof remains on the original cylinder, and it is virtually impossible to achieve anything even remotely close to 100% transfer of liquid printing ink.

The same problem exists in the transfer of solid printing ink which is in a granular state, such as toner powder, for example. To be sure, electrostatic transfer techniques which achieve a transfer efficiency of approximately 95 to 98% maximum have become known heretofore; however, this is only for applications using non-conducting toner. For production presses with an output of many thousands of sheets per hour, this is not sufficient, however, because it would be necessary permanently for the cleaning devices to be replaced and to be cleaned outside the printing press, respectively.

In an article entitled "Offset Quality Electrophotography" in the "journal of Imaging Science and Technology", Volume 37, No. 5, September/October 1993, p. 458 (hereinafter referred to as "OQE"), various xerographic techniques which are suitable for transferring conductive toner even when the humidity is quite high are described. In one of the techniques, the toner is transferred under pressure onto a substrate and is simultaneously fixed. A further technique calls for a thermal or heat transfer in two temperature stages. In addition, combinations of transfer under pressure and thermal transfer are described therein. Such a combination is presented on page 459 of the aforementioned publication. The toner is transferred by pressure from a first cylinder onto an intermediate cylinder and then by thermal transfer onto paper which runs between the intermediate cylinder and a heated impression cylinder. An efficiency of 95% is supposed to be achieved in the case of transfer by pressure, while an efficiency of 100% is attained in the case of thermal transfer.

In the periodical "The Seybold Report on Publishing Systems", Volume 24, No. 20, page 20, left-hand column (hereinafter referred to as the "Seybold Report"), a transfer system is described wherein an image is transferred to paper through the intermediary of two belts. One of the belts accepts the toner in a distribution corresponding to the printed image. The image is then transferred to the other belt, which is heated. The latter belt is not hot enough to melt the toner, but the heat thereof is sufficient to cause the toner particles to adhere to one another. The heated belt then transfers the image onto the paper, which is preheated, the image being fixed by means of a hot pressure roller. Consequently, no subsequent melting or fixing of the toner is required.

In the first step, the transfer from a first belt to a second belt, it is not possible at all to achieve a transfer efficiency of 100%. The first belt is, in fact, teflon-coated, and basically exerts at least small adhesion forces on the toner, so that, in the first step at least, a transfer efficiency of less than 100% is to be assumed, as is similar to the situation with the technique described in the aforementioned "Offset Quality Electrophotography" article.

In both of the aforedescribed techniques, the toner is thus not transferred in its entirety from the cylinder and from the first belt, respectively. Particularly with regard to recently developed printing techniques, e.g., the printing technique described in the "Seybold Report", it is necessary, however, for the remaining printing ink to be entirely removed before new printing ink is applied to the first belt and to the first cylinder, respectively, in order to attain a perfect print. This may be very difficult and costly, particularly if the printing ink is to be reused.

SUMMARY OF THE INVENTION

It is accordingly an object of the invention to provide a method and a device for transferring printing ink wherein transfer techniques are used which virtually always have a transfer efficiency of 100%, not only when transferring ink onto paper, but also when transferring ink onto an intermediate carrier.

With the foregoing and other objects in view, there is provided, in accordance with one aspect of the invention, a method of transferring printing ink from an intermediate carrier to a printing-ink receiver selected from the group consisting of a further intermediate carrier and a substrate, wherein the printing ink adheres in a granular state to the intermediate carrier, which comprises melting the printing ink at a side thereof facing away from the intermediate carrier before transferring the printing ink to the printing-ink receiver.

In accordance with another aspect of the invention, there is provided a method of transferring printing ink from an intermediate carrier to a printing-ink receiver selected from the group consisting of a further intermediate carrier and a substrate, wherein the printing ink adheres in an at least partially liquid state to the intermediate carrier, which comprises reducing the adhesion of the printing ink to the intermediate carrier with a separating agent at one time at least before and during transfer to the printing-ink receiver.

In accordance with a further mode, wherein the intermediate carrier has an outer elastic layer containing the separating agent, the method according to the invention includes pressing the intermediate layer and the printing-ink receiver against one another so as to drive the separating agent to the surface of the elastic layer.

In accordance with an added aspect of the invention, there is provided a device for transferring printing ink from an inking unit via an intermediate carrier to a printing-ink receiver selected from the group consisting of a further intermediate carrier and a substrate, comprising a heat source disposed opposite a surface of the intermediate carrier, the surface extending between the inking unit and the printing-ink receiver.

In accordance with an additional aspect of the invention, there is provided a device for transferring printing ink from an inking unit, comprising an intermediate carrier for receiving printing ink from the inking unit and for transferring the printing ink to a printing-ink receiver selected from the group consisting of a further intermediate carrier and a substrate, the intermediate carrier having at least one of the properties consisting of being permeable to a separating agent and having a storage capacity for a separating agent.

In accordance with yet another aspect of the invention, there is provided a device for transferring printing ink from an inking unit of a printing press to a substrate being transported through the printing press, comprising a first intermediate carrier adjoining the inking unit and having a surface to which printing ink is transferrable from the printing unit, and a second intermediate carrier disposed so as to be in contact with the first intermediate carrier and the substrate and having a surface extending between the first intermediate carrier and the substrate for transferring printing ink from the first intermediate carrier to the substrate, comprising a first heat source disposed opposite the surface of the first intermediate carrier, and a second heat source disposed opposite the surface of the second intermediate carrier.

In accordance with yet a further aspect of the invention, there is provided a device for transferring printing ink from an inking unit of a printing press to a substrate being transported through the printing press, comprising a first intermediate carrier adjoining the inking unit and having a surface to which printing ink is transferrable from the printing unit, and a second intermediate carrier disposed so as to be in contact with the first intermediate carrier and the substrate and having a surface extending between the first intermediate carrier and the substrate for transferring printing ink from the first intermediate carrier to the substrate, comprising a first heat source disposed opposite the surface of the first intermediate carrier, and the second intermediate carrier being provided with at least one of a second heat source disposed opposite the surface of the second intermediate carrier and a capability for being permeable to a separating agent at a side thereof facing the printing ink.

In accordance with yet another aspect of the invention, there is provided a device for transferring printing ink from an inking unit of a printing press to a substrate being transported through the printing press, comprising a first intermediate carrier adjoining the inking unit for receiving thereon printing ink transferred from the printing unit, and a second intermediate carrier disposed so as to be in contact with the first intermediate carrier and the substrate for transferring printing ink from the first intermediate carrier to the substrate, both the first intermediate carrier and the second intermediate carrier being permeable to a separating agent at a side thereof facing the printing ink.

In accordance with another feature of the invention, the device in a printing press having a plurality of inking units includes a plurality of first intermediate carriers and a second intermediate carrier, each of the first intermediate carriers, respectively, adjoining one of the inking units and the second intermediate carrier, the second intermediate carrier being disposed so as to contact all of the first intermediate carriers and a substrate being transported through the printing press, and a heat source disposed opposite a surface of the second intermediate carrier, the surface extending between at least one of the first intermediate carriers and the substrate.

In accordance with a further feature of the invention, the device in a printing press having a plurality of inking units includes a plurality of first intermediate carriers and a second intermediate carrier, each of the first intermediate carriers, respectively, adjoining one of the inking units and the second intermediate carrier, the second intermediate carrier being disposed so as to contact all of the first intermediate carriers and a substrate being transported through the printing press, the second intermediate carrier being permeable to a separating agent at a side thereof facing the printing ink.

In accordance with an added feature of the invention, the device in a printing press having a plurality of inking units includes a first intermediate carrier and a second intermediate carrier, each of the plurality of inking units adjoining the first intermediate carrier and the second intermediate carrier, the second intermediate carrier being disposed so as to contact the first intermediate carrier and a substrate being transported through the printing press, and a heat source disposed opposite a surface of the second intermediate carrier, the surface extending between the first intermediate carrier and the substrate.

In accordance with an additional feature of the invention, the device in a printing press having a plurality of inking units includes a first intermediate carrier and a second intermediate carrier, each of the plurality of inking units adjoining the first intermediate carrier and the second intermediate carrier, the second intermediate carrier being disposed so as to contact the first intermediate carrier and a substrate being transported through the printing press, the second intermediate carrier being permeable to a separating agent at a side thereof facing the printing ink.

In accordance with yet another feature of the invention, the intermediate carrier contacting the substrate has an outer elastic layer containing the separating agent therein.

In accordance with yet a further feature of the invention, the separating agent is an ink-repelling liquid.

In accordance with yet an added feature of the invention, the ink-repelling liquid is silicone oil.

In accordance with yet an additional feature of the invention, the intermediate carrier is one of a rotating transfer cylinder and a belt revolving around a cylinder.

In accordance with still another feature of the invention, the device includes an impression cylinder journalled opposite a side of the substrate whereon a surface of the one of the rotating transfer cylinder and the belt revolving around a cylinder rolls.

In accordance with still a further feature of the invention, the heat source is formed so as to concentrate radiation on one of the intermediate carrier and the substrate.

In accordance with still an added feature of the invention, the heat source is one of a laser, an array of lasers and an array of laser diodes.

In accordance with a concomitant feature of the invention, the device includes a control device for generating control signals connected to the one of the laser, the array of lasers and the array of laser diodes, the control signals corresponding to a distribution of the printing ink on the printing-ink receiver.

It is thus a more specific objective of the invention, when, in the aforementioned method, the printing ink adheres in a granular state to an intermediate carrier, to effect an initial melting of the printing ink at a side thereof facing away from the intermediate carrier, before the printing ink is transferred to another intermediate carrier or to the substrate.

It is a further specific objective of the invention, when, in the aforementioned method, the printing ink adheres in an at least partially liquid state to the intermediate carrier, to reduce the adhesion of the printing ink to the intermediate carrier by applying a separating agent before and/or during the ink transfer to the other intermediate carrier or to the substrate.

In an embodiment of the invention, the intermediate carrier has an outer elastic layer, such as a rubber layer, the separating agent being contained in the layer and the separating agent being driven to the surface of the rubber layer when the intermediate carrier and either the further intermediate carrier or the substrate, as the case may be, are pressed against one another. In a further embodiment relating to the use of a separating agent, the intermediate carrier has a hard outer layer, such as a porous layer formed of sintered material or ceramic, the outer layer being capable of effectively storing a separating agent therein. The loss of separating agent occurring during operation can be compensated for by a corresponding feeding device, or the separating agent is added to the ink, so that an equilibrium in the supply of separating agent is attained during operation.

An intermediate carrier is understood to mean a device having a surface whereon a printed image in the form of an ink distribution is created, further transported and subsequently destroyed or removed, i.e., for example, a rotating transfer cylinder or a belt revolving around a cylinder, the ink being transferred either onto a further intermediate carrier or onto a substrate.

A transfer efficiency of virtually 100% is achieved both in the case of the transfer of solid ink according to the invention, i.e. transfer by a melting start-up, the printing ink being predominantly solid, and also in the case of the transfer of liquid inks assisted by a separating agent.

In the case of the start-up melting of a granular printing ink from outside, assurance is provided, firstly, that the ink particles adhere to one another. Secondly, the adhesion of the printing ink to the intermediate carrier is not increased by the start-up melting, because the start-up melting takes place only on the outer surface of the ink film, while, on the side facing the intermediate carrier, the printing ink continues to adhere only at individual points to the intermediate carrier. Therefore, coherent ink islands on the intermediate carrier can easily and completely be removed therefrom. Thirdly, the start-up or initial melting of the printing ink from outside results in a stronger adhesion thereof to the following intermediate carrier or substrate, thereby additionally ensuring the complete transfer of the printing ink.

Otherwise than in the process known from the "Seybold Report", according to the invention of the instant application, the solid printing ink does not undergo start-up or initial melting from the inside, but rather, on the outside. Whereas the conventional technology makes the stripping or removal removal of the printing ink from the intermediate carrier more difficult, the stripping or removal forces required in accordance with the invention continue to remain small and, moreover, the adhesion on the target carrier is improved. Consequently, in the method for transferring solid ink, according to the invention, the transfer method is in a plurality of respects more reliable than in the conventional process. With little design effort and with little expenditure of energy, a transfer efficiency of 100% is attained, the contact-pressure forces required for transfer onto a substrate such as paper being small, so that the paper is treated more gently.

This applies not only when the printing ink is transferred directly onto a substrate such as paper, which assists transfer due to the strong capillary action thereof, but also in the case of a multistage process wherein the printing ink is transferred onto the substrate via a further intermediate carrier. The complete transfer of a latent image, developed on a first intermediate carrier, onto a second intermediate carrier and from there onto a substrate imposes contradicting requirements on the two processes. First of all, the affinity of the printing ink to the second intermediate carrier must be greater than the affinity thereof to the first intermediate carrier; secondly, the affinity of the printing ink to the substrate must be greater than the affinity thereof to the second intermediate carrier. Therefore, the second intermediate carrier must initially accept the printing ink before then releasing it again. Because, in accordance with the invention, the stripping or removal of the printing ink from the first intermediate carrier after the development thereof is facilitated, a lesser affinity is required on the second intermediate carrier than if the stripping or removal were not assisted, in order for the ink to be transferred completely onto the second intermediate carrier. The low adhesion forces on the second intermediate carrier make it easier for the printing ink subsequently to be transferred completely onto the substrate.

If the start-up melting method according to the invention is likewise used for transfer onto the substrate, then the method of transfer and final fixing require overall considerably less heat energy than in conventional techniques, wherein the printing ink is melted by heating the intermediate carrier or by preheating the paper. The paper does not dry out during printing and is treated more gently.

If the printing ink is on the intermediate carrier in an at least partially liquid state or has been brought to such a state, then, in accordance with the invention, a separating agent is used in order to ensure 100% transfer. The printing ink may be either an ink which is liquid at normal temperature, or a meltable ink which is solid at normal temperature and is kept at a temperature above the melting temperature. In the latter case, for example, the intermediate carrier is provided with a heated outer layer of high thermal conductivity and low thermal capacity and with an insulating layer lying therebelow in order to keep the heat losses low.

The use of a separating agent is particularly advantageous if the intermediate carrier is in the form of a rubber-covered transfer cylinder which transfers the liquid printing ink onto a substrate. An elastic layer of the transfer cylinder formed, for example, of rubber or a similar material and being able huggingly to adapt to an uneven substrate surface in order to ensure uniform ink transfer without having to exert excessive pressure, serves simultaneously as the carrier for the separating agent which, in the preferred embodiment, is silicone oil. The capacity of the elastic layer to absorb the separating agent may be based on diffusion and/or on the penetration of the separating agent into micropores of the elastic layer. When the elastic layer is pressed against the substrate, the silicone oil is driven out, so that the printing ink is repelled from the surface of the transfer cylinder. At the same time, the printing ink is driven into the substrate surface, so that the complete transfer of the ink is achieved in an especially simple manner.

In the case of more modern inking units, particularly in the case of digital inking units, it is necessary, for technical reasons, that the printing ink be applied initially to a first intermediate carrier which has a hard surface. If the printing ink is liquid, in this case, provision may be made for the first intermediate carrier to be formed with micropores through which a separating agent may be pressed, before and/or during the transfer of the printing ink, onto a second intermediate carrier, the separating gas being, in this case, not restricted to a liquid only, but also possibly being a gas. If the printing ink, conversely, is originally solid, then the solid-ink transfer according to the invention is performed on the first intermediate carrier, while either the solid-ink transfer or the liquid-ink transfer according to the invention is performed on the second intermediate carrier.

A printing press with one or more printing units according to the invention includes a transport device, such as a conventional conveyor with chains and grippers or a transport belt, the transport device conveying substrates consecutively through the in-line printing units, the substrates being pressed against the corresponding intermediate carriers by means of impression cylinders.

Furthermore, due to the high transfer efficiency, simplified constructions for multicolor printing presses are possible.

The heat sources used in the various embodiments for start-up or initial melting or for fixing may be, for example, infrared radiators which concentrate the radiation onto the intermediate carrier or substrate. The location on the intermediate carrier at which the radiation is concentrated should be as close as possible to the location at which the printing ink is transferred onto the further intermediate carrier or substrate, so that, on the travel path of the printing ink to the transfer location, as little heat as possible flows onto the intermediate carrier and the printing ink need not be heated to a considerably higher temperature than is required for transfer, respectively.

Best suited for the concentration of the radiation are lasers, the radiation of which is converted at the point of incidence into heat. Through a suitable choice of the radiation wavelength, it is possible to ensure that the radiation be absorbed with a higher efficiency by the printing ink and with a lower efficiency by the intermediate carrier or substrate, respectively, so that the intermediate carrier and the substrate are heated as little as possible. Even more selective heating is possible with the aid of an array of lasers or of laser diodes, which are controlled in conformance with the transferred printing image, in order to heat only those locations which bear the printing ink. The information required for generating such a heating pattern is known from the control of the imaging heads. Given a corresponding resolution of the laser-diode array, it is possible to implement heat transfer to pixel accuracy and, with the aid of the gray-value information, it is possible to take into account the respective ink-film thickness. Consequently, the supply of heat can be measured so that, upon the transfer of the printing ink to the paper, the printing ink has the same temperature overall, irrespective of other parameters, thereby assuring a reliable transfer of the ink.

Other features which are considered as characteristic for the invention are set forth in the appended claims.

Although the invention is illustrated and described herein as a method and device for transferring printing ink, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
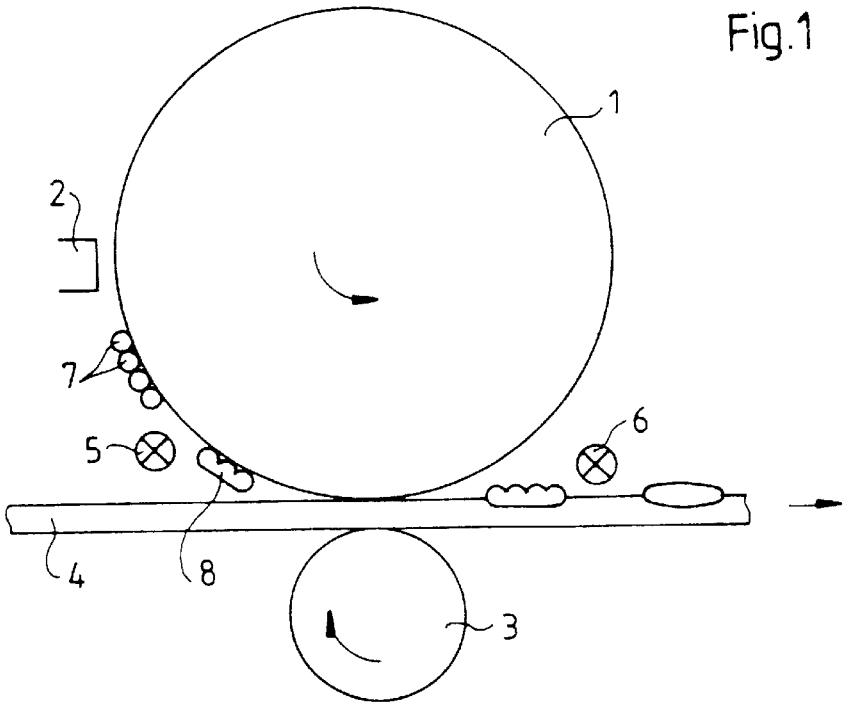
FIG. 1 is a basic diagrammatic side elevational view of a first embodiment of a printing unit for effecting a solid ink transfer.

Referring now to the drawings and, first, particularly to FIG. 1 thereof, there is shown therein a printing unit with a transfer cylinder 1, a diagrammatically represented inking unit 2 and an impression cylinder 3, as well as a substrate 4. A heat source 5 is disposed opposite the surface of the transfer cylinder 1 and between the inking unit 2 and the substrate 4, and a heat source 6 is disposed opposite the printed side of the substrate 4.

During the operation of the printing unit shown in FIG. 1, the transfer cylinder 1 and the impression cylinder 3 rotate in the directions indicated by the curved arrows respectively associated therewith, while a non-illustrated transport apparatus conveys the substrates 4 consecutively through the nip located between the transfer cylinder 1 and the impression cylinder 3, in the direction of the straight arrow.

At the inking unit 2, ink particles 7 are applied to the transfer cylinder 1 in a distribution corresponding to a printing image which is to be formed. The ink particles 7 are represented in the drawing as spheres of like size; in practice, however, they are irregularly shaped. While the ink particles 7 are being further transported by the transfer cylinder 1, they are melted from the outside by a heat source 5 which is directed thereon, so that cohesive ink islands 8 are formed. In the ink islands 8, the printing ink adheres, as in the ink particles 7 beforehand, only at respective points to the transfer cylinder 1, as represented diagrammatically in FIG. 1. As long as this point-wise adhesion is not markedly changed, the intensity of the melting is not critical. What is important is that the plasticity in the ink islands 8 should increase from the inside to the outside thereof, and that the outer surface of the ink islands 8 should not yet be completely melted. Due to the glasslike melting behavior of conventional solid inks, it is relatively easy to satisfy these conditions.

Between the transfer cylinder 1 and the impression cylinder 3, the substrate 4 is pressed onto the transfer cylinder 1, the printing ink being transferred to the substrate 4. Because the printing ink has become melted on the side thereof facing away from the transfer cylinder 1, the ink islands 8 are cohesively and easily transferred to the substrate 4. The impression or pressure forces between the substrate 4 and the transfer cylinder 1 can consequently be kept small. The printing ink is then fixed by means of the heat source 6, it being sufficient, in many cases, to heat the ink islands 8 at the surface in order to smooth finish them. Alternatively or additionally, the substrate 4 may be preheated by a suitable non-illustrated device before the substrate 4 passes the transfer cylinder 1.

Figure 2:
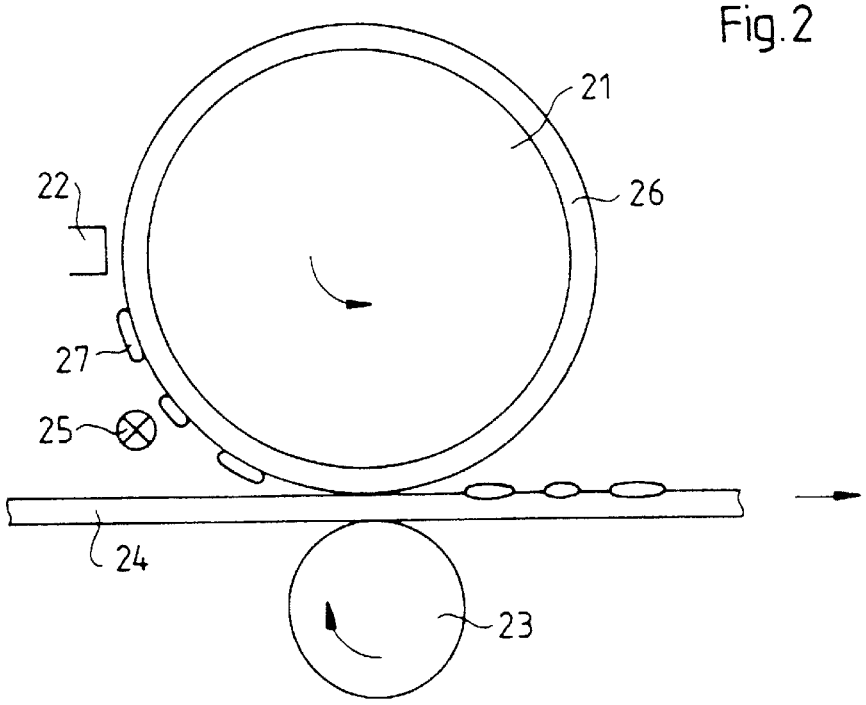
FIG. 2 is a view like that of FIG. 1 of a second embodiment of a printing unit for effecting a liquid ink transfer.

FIG. 2 shows a printing unit with a transfer cylinder 21, an inking unit 22 and an impression cylinder 23, as well as a substrate 24. A heat source 25 is disposed opposite the surface of the transfer cylinder 21 and between the inking unit 22 and the substrate 24.

The transfer cylinder 21 is a rubber-covered cylinder with an outer rubber jacket 26. The material of the rubber jacket 26 has an absorption capacity for a silicone oil, with which it is quite saturated.

The operation of the printing unit shown in FIG. 2 is similar to that of the printing unit in FIG. 1. Unlike the inking unit 2 of the printing unit in FIG. 1, however, the inking unit 22 of FIG. 2 does not apply individual ink particles to the transfer cylinder 21, but rather, a liquefied printing ink which is normally solid at room or normal temperature. Ink islands 27 formed in accordance with the printed image are kept liquid by the heat source 25 or by heating the transfer cylinder 21 as the ink islands 27 travel to the substrate 24.

The rubber jacket 26 of the transfer cylinder 21 becomes slightly compressed at the impression cylinder 23, so that previously absorbed silicone oil is expelled from the rubber jacket 26, breaking the adhesion between the printing ink and the transfer cylinder 21. Consequently, no cracking of the printing ink occurs, and the printing ink is transferred in its entirety to the substrate 24.

After the pressure on the rubber jacket 26 has been released, the majority of the silicone oil is re-absorbed by the rubber jacket 26. A non-illustrated conventional oil-feeding device is provided to compensate for any losses.

If necessary, the substrate 24 in this embodiment can be preheated by a suitable non-illustrated device before the substrate 24 passes the transfer cylinder 21.

Figure 3:
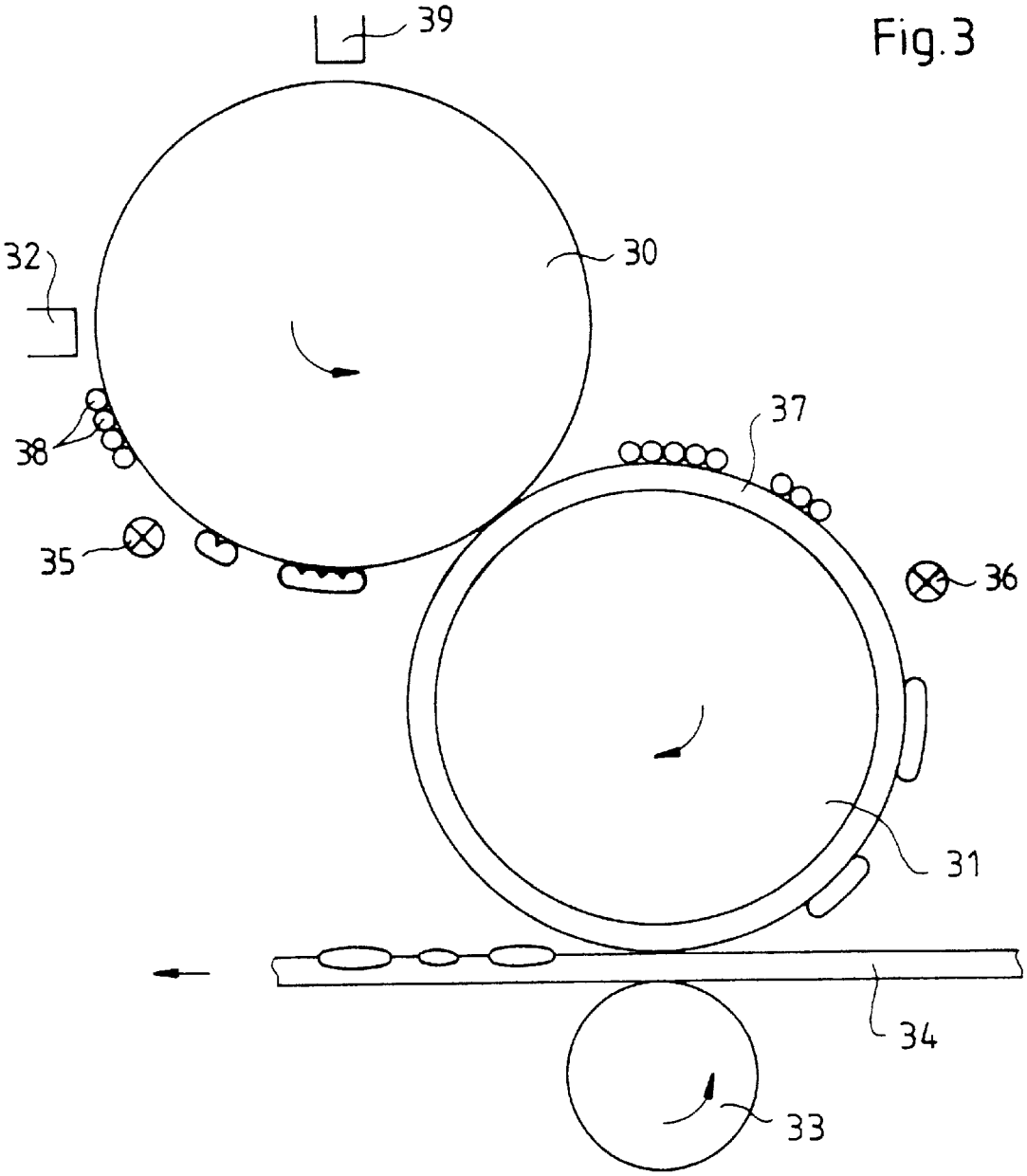
FIG. 3 is a view like those of FIGS. 1 and 2 of a third embodiment of a printing unit for effecting a two-stage ink transfer, namely a combination of solid ink transfer and liquid ink transfer.

FIG. 3 shows a printing unit with a first transfer cylinder 30, a second transfer cylinder 31, an inking unit 32 and an impression cylinder 33, as well as a substrate 34. A heat source 35 is disposed opposite the surface of the first transfer cylinder 30 and between the inking unit 32 and the second transfer cylinder 31, and a heat source 36 is disposed opposite the surface of the second transfer cylinder 31 and between the first transfer cylinder 30 and the substrate 34. The second transfer cylinder 31 is provided with a silicone oil-containing rubber jacket 37, as was described in connection with FIG. 2.

During the operation of the printing unit shown in FIG. 3, the first transfer cylinder 30, the second transfer cylinder 31 and the impression cylinder 33 rotate in the directions represented by the respective curved arrows associated therewith, while a non-illustrated transport device conveys substrates 34 consecutively through the nip between the second transfer cylinder 31 and the impression cylinder 33 in the direction of the straight arrow.

At the inking unit 32, ink particles 38 are applied to the first transfer cylinder 30 in accordance with a latent printed image generated in an otherwise non-described manner by a conventional diagrammatically represented imaging head 39. Transfer of the printing ink to the second transfer cylinder 31 is accomplished in the same manner as was described in connection with FIG. 1. The printing ink is completely melted on the second transfer cylinder 31 by means of the heat source 36 and/or by heating the transfer cylinder 31, and is then transferred to the substrate 34 in the same manner as was described in connection with FIG. 2.

With the arrangement shown in FIG. 3, it is further possible to dispense with a separating agent if the transfer of ink from the second transfer cylinder 31 to the substrate 34 is likewise effected in a manner similar to that in FIG. 1, i.e., by melting the outside of the printing ink by means of the heat source 36, while the inside of the printing ink is chilled on the transfer cylinder 31. The increased adhesion of the printing ink to the second transfer cylinder 31 due to the preceding melting is at least balanced by the considerably greater adhesion of the printing ink to the substrate 34. In this case also, complete transfer of the ink is possible, if necessary or desirable, by suitable additional measures, such as by preheating the substrate 34. Instead of the combination of solid-ink and liquid-ink transfer depicted in FIG. 3, a two-stage transfer of more-or-less solid printing ink is realized.

Figure 4:
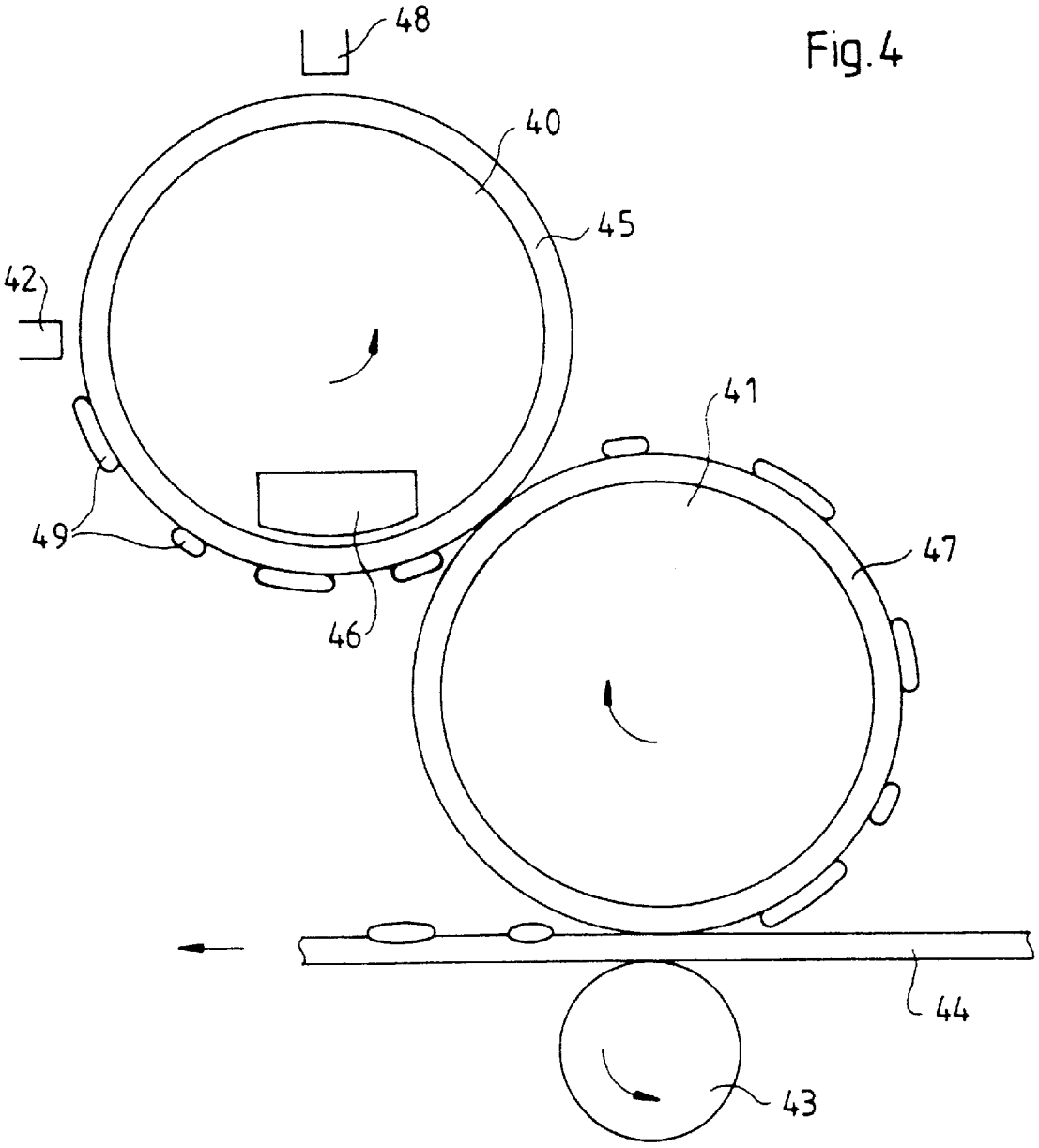
FIG. 4 is a view like those of FIGS. 1, 2 and 3 of a fourth embodiment of a printing unit for effecting a two-stage liquid ink transfer.

FIG. 4 shows a printing unit with a first transfer cylinder 40, a second transfer cylinder 41, an inking unit 42 and an impression cylinder 43, as well as a substrate 44. The first transfer cylinder 40 has a jacket 45, which is permeable to a separating agent fed thereto by a suitable feeding device 46. In the embodiment of FIG. 4, the feeding device 46 is diagrammatically represented as being inside the jacket 45 of the transfer cylinder 40, but it may also be disposed adjacent to the outer surface thereof in order to keep the quantity of separating agent stored in the porous jacket 45 constant during operation. If a separating agent is added to the printing ink itself, equilibrium is automatically attained during operation. The second transfer cylinder 41 has a silicone oil-containing rubber jacket 47, as was described in connection with FIG. 2.

The printing unit shown in FIG. 4 operates in a manner similar to that of the printing unit shown in FIG. 3. Unlike the inking unit 2 in FIG. 1, however, the inking unit 42 of FIG. 4 does not apply individual ink particles, but rather, a liquefied printing ink to the first transfer cylinder 40. In conformity with a latent printed image generated by an imaging head 48, ink islands 49 are formed on the first transfer cylinder 40, the ink islands 49 being kept liquid, e.g., by heating the transfer rollers 40 and 41, as the ink islands 49 travel farther on their way via the second transfer cylinder 41 to the substrate 44.

During the transfer of the printing ink from the first transfer cylinder 40 to the second transfer cylinder 41 and from the second transfer cylinder 41 to the substrate 44, use is made of a separating agent, respectively, as was described in connection with FIG. 2, care being taken, however, by suitable constructive measures that the first transfer cylinder 40 be provided with a hard surface which can be written on by the imaging head 48.

Although the foregoing embodiments of the invention for transferring printing ink in liquid form have been described with reference to a liquefied printing ink which is solid at normal or room temperature, they are basically also suitable for transferring printing ink which is liquid at normal or room temperature.

Figure 5:
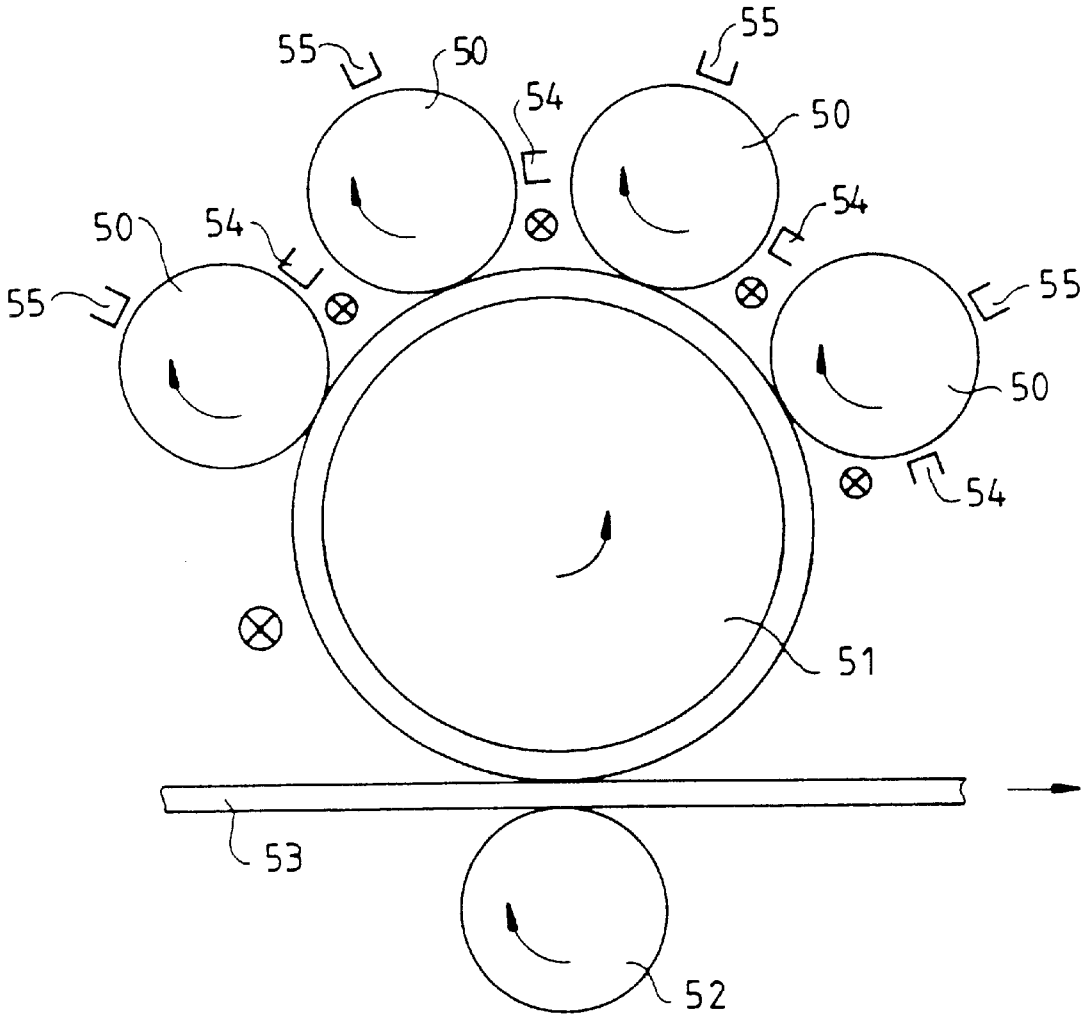
FIG. 5 is a view like those of FIGS. 1 to 4 of a first embodiment of a multicolor printing press for effecting a two-stage ink transfer.

FIG. 5 shows four first transfer cylinders 50, a second transfer cylinder 51, an impression cylinder 52, as well as a substrate 53. The four first transfer cylinders 50 are disposed in-line or in tandem at the circumference of the second transfer cylinder 51, and an inking unit 54 and an imaging head 55 are disposed at the circumference of each of the first transfer cylinders 50. Furthermore, a heat source is disposed at the circumference of each of the transfer cylinders 50 and 51.

During the operation of the printing unit shown in FIG. 5, the first transfer cylinders 50, the second transfer cylinder 51 and the impression cylinder 52 rotate in the directions represented by the respective curved arrows associated therewith, while a non-illustrated transport device conveys substrates 53 consecutively through a nip between the second transfer cylinder 51 and the impression cylinder 52 in the direction of the straight arrow shown associated therewith.

The printing inks are transferred in a manner similar to that described in connection with FIG. 3 or, not represented in this connection, in a manner similar to that described in connection with FIG. 4, all four printing inks being transferred during one revolution of the second transfer cylinder 51.

Figure 6:
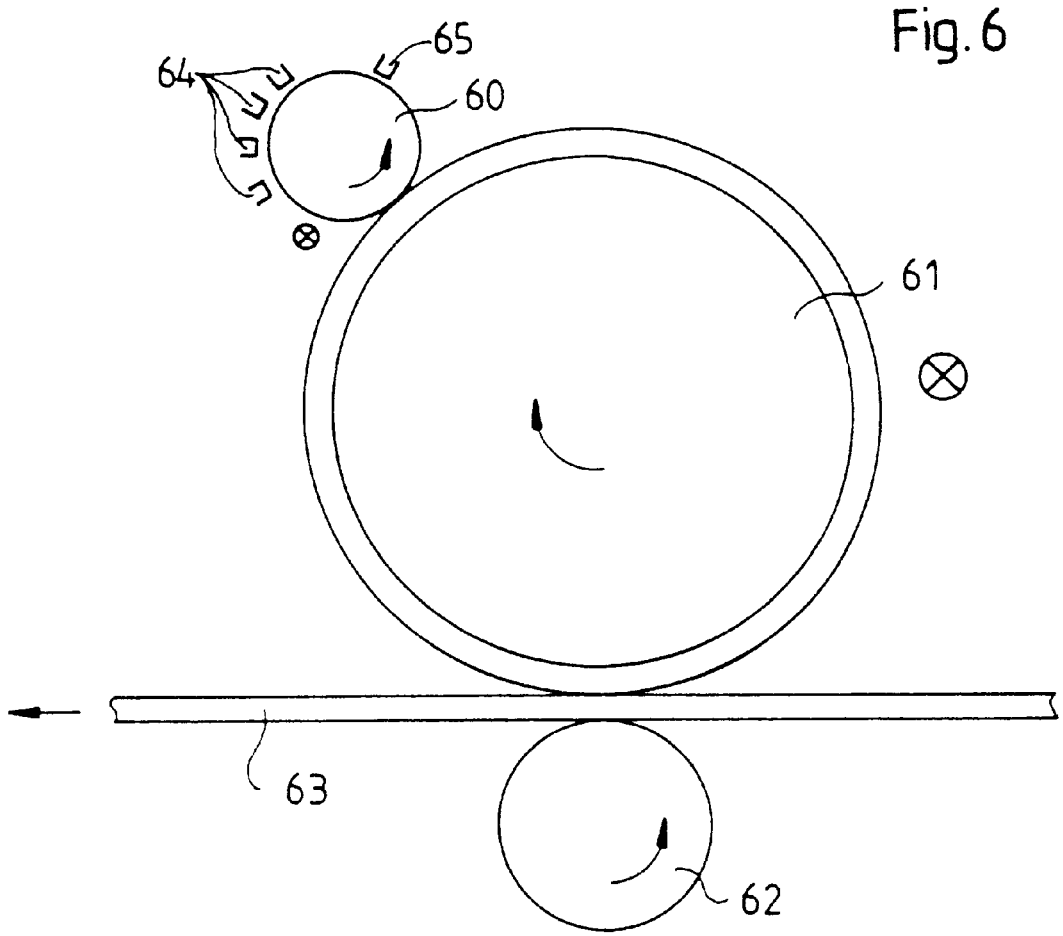
FIG. 6 is a view like those of FIGS. 1 to 5 of a second embodiment of a multicolor printing press for effecting a two-stage ink transfer.

FIG. 6 shows a first transfer cylinder 60, a second transfer cylinder 61, an impression cylinder 62, as well as a substrate 63. The circumference of the second transfer cylinder 61 is four times as large as the circumference of the first transfer cylinder 60. Four inking units 64 and an imaging head 65 are disposed at the circumference of the first transfer cylinder 60. Furthermore, a heat source is disposed at the circumference of each of the transfer cylinders 60, 61.

During the operation of the printing unit shown in FIG. 6, the first transfer cylinder 60, the second transfer cylinder 61 and the impression cylinder 62 rotate in the directions represented by the curved arrows associated therewith, while a non-illustrated transport device conveys substrates 63 consecutively through a nip formed between the second transfer cylinder 61 and the impression cylinder 62 in the direction of the straight arrow.

The printing inks are transferred in a manner similar to that described in connection with FIG. 3 or, not represented in this connection, in a manner similar to that described in connection with FIG. 4, a respective printing ink being transferred to the transfer cylinder 61 upon each revolution of the transfer cylinder 60.

As is apparent from FIG. 5 and FIG. 6, respectively, the embodiments illustrated therein are multicolor printing presses with a two-stage ink transfer, wherein several transfer cylinders are dispensed with.

Infrared radiators, for example, are taken into consideration as the heat sources used in the aforedescribed embodiments. Further, particularly suitable heat sources are described in connection with FIGS. 7 and 8.

Figure 7:
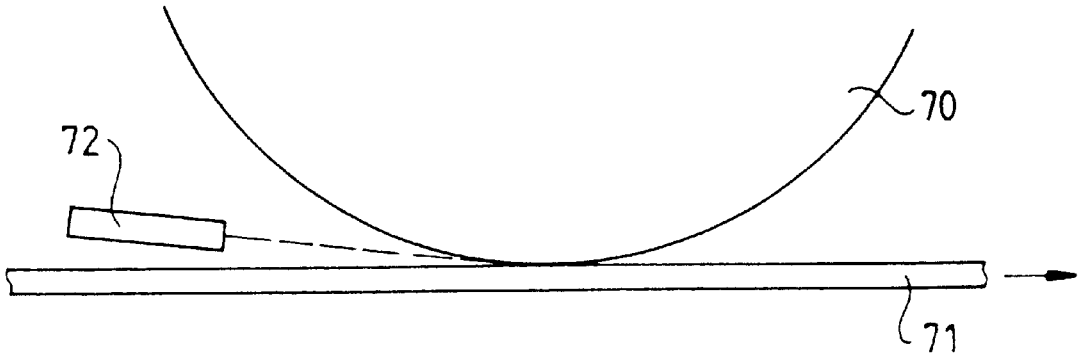
FIGS. 7 and 8 are diagrammatic and schematic side elevational views of a printing unit showing various heat sources suitable for the embodiments of FIGS. 1 to 6.

FIG. 7 shows diagrammatically a transfer cylinder 70, a substrate 71 being transported in a direction represented by the arrow associated therewith and a laser 72 for melting the outside of the printing ink which is being transferred from the transfer cylinder 70 to the substrate 71. The laser 72 is, for example, a carbon-dioxide laser, directing the radiation therefrom along the broken line into the nip between the transfer cylinder 70 and the substrate 71, whereat it is absorbed by the printing ink and converted into heat. At the point formed by the converging surfaces of the transfer cylinder 70 and the substrate 71, a manifold or multiple reflection occurs in a direction towards the transfer location, so that the radiation energy is guided very closely to the transfer location. The radiation is uniformly distributed over the length of the nip between the transfer cylinder 70 and the substrate 71 by means of lenses or mirrors, and/or a plurality of lasers 72 are provided along the length of the transfer cylinder 70.

At least in the case of the hereinafore-described transfer of ink by melting, the radiation is concentrated as intensely as possible, i.e., it is concentrated in a linear region, which is as narrow as possible, along the transfer cylinder 70. This applies also, or especially, if the radiation, assisted by reflection, is not directly introduced into the nip between the transfer cylinder 70 and the substrate 71, but rather, impacts before the transfer location, albeit as slightly as possible. With the aid of lasers, it is possible to attain a linear radiation area with a width within the range of micrometers, so that the printing ink passing the irradiated area is subjected only very briefly to radiation energy. Assurance is thereby provided that the printing ink is actually heated only on the outer surface thereof and is therefore melted only on the surface thereof.

If a carbon-dioxide laser is used, the radiation is, in any case, absorbed by the printing ink. However, polymeric coloring agents also absorb shorter-wave light, so that, for example, it is also possible to employ ND-YAG lasers. The shortwave light offers the advantage that the individual ink islands on the transfer cylinder 70 can be heated selectively, with maximum care or protection being given to the substrate 71 and with minimum heating of the transfer cylinder 70. The latter aspect is particularly important if the transfer cylinder 70 is a developing cylinder which, if there is heating at the transfer location, must subsequently be cooled again in order to ensure proper development.

An embodiment of the invention offering selective heating of the ink islands which permits uniform heating of printing ink which is provided both with locally differing distribution, as well as with differing thickness, is described hereinafter with reference to FIG. 8.

Figure 8:
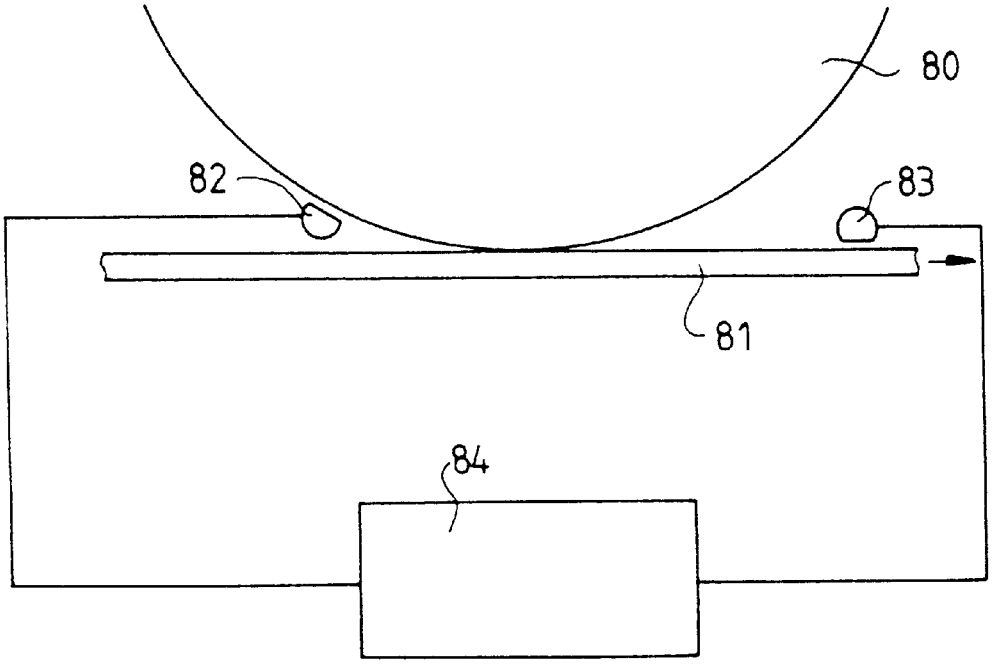

FIG. 8 shows diagrammatically a transfer cylinder 80, a substrate 81 which is transported in the direction of the arrow associated therewith and a laser-diode array 82 for externally melting printing ink which is being transferred from the transfer cylinder 80 to the substrate 81. The laser-diode array 82 extends along the length of the transfer cylinder 80, being disposed close to the transfer cylinder 80 and as near as possible to the point of transfer to the substrate 81.

The laser-diode array 82 is controlled by a control device 84, which receives from a non-illustrated computer of the printing press the very same image information, including the gray values, which is also fed to the s of the printing unit. The control device 84 controls the laser-diode array 82, taking the time offset into account, so that the ink film on the transfer cylinder 80 is supplied with heat in accordance with the areal distribution and the respective thickness thereof.

In this manner it is possible to ensure that the printing ink is at the same temperature throughout at the instant of transfer thereof from the transfer cylinder 80 to the substrate 81. Except for the heat which flows onto the transfer cylinder 80 on the short path to the printing-ink transfer location, the transfer cylinder 80 does not absorb any other heat.

Figure 9:
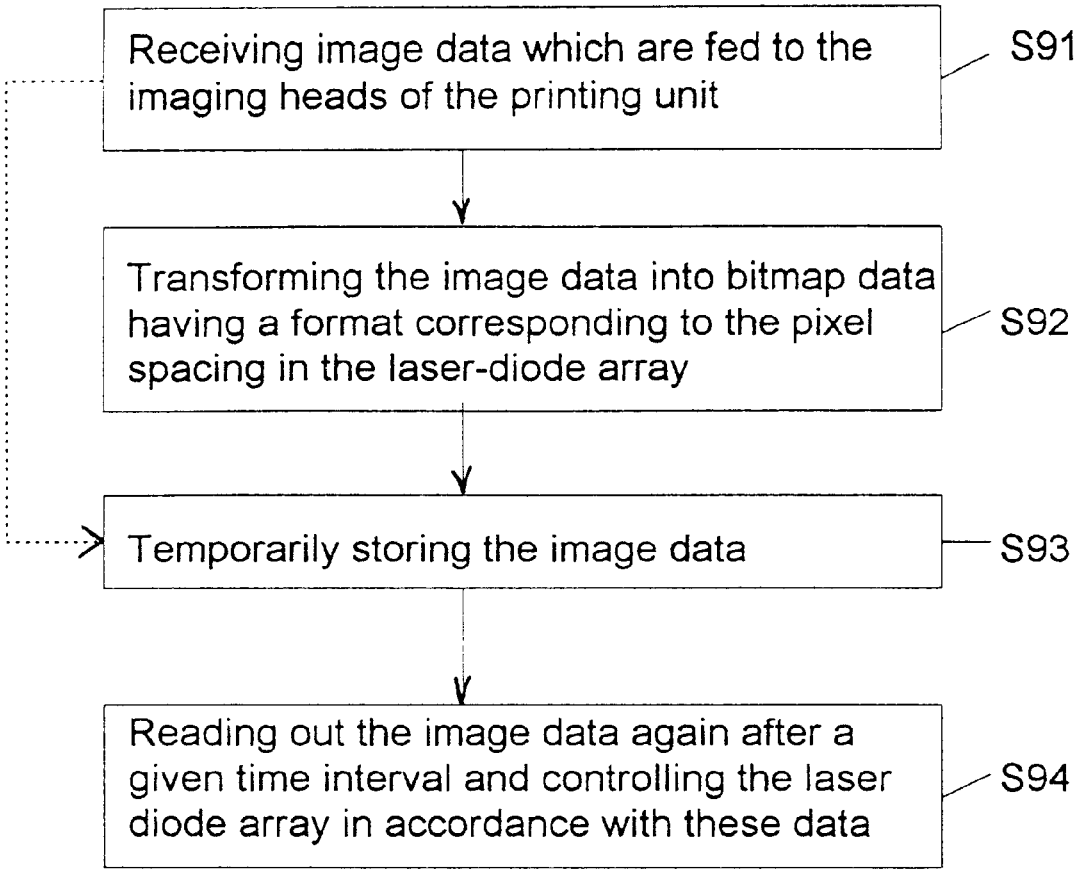
FIG. 9 is a flow chart depicting the operation, in accordance with the invention, of a control device shown in FIG. 8.

The control device 84 may, for example, be a microprocessor with an integrated memory and may operate as shown in the flow chart of FIG. 9. In step S 91, the image data activating the imaging heads of the printing unit are received, while a substrate is being printed. If the pixel resolution of the laser-diode array 82 is not identical with the resolution of the imaging heads, the image data are transformed, in step S 92, into bitmap data having a format corresponding to the pixel spacing in the laser-diode array 82, and stored temporarily (step S 93). If the pixel resolution of the laser-diode array 82 is identical with the resolution of the imaging heads, the image data may be stored immediately as represented by the broken line. After a time interval during which the location on the substrate which is being printed moves from the imaging heads to the laser-diode array 82, the image data are read out again line by line in step S 94 and transformed into respective activating signals for the laser-diode array 82. The laser-diode array 82 activated by the signals irradiates and heats the substrate pixelwise in accordance with the respective ink thickness. These functions may be performed not only by a separate control device 84 but also completely or partly by the printing-press computer.

Selective heating is most accurately effected if the pixel resolution of the laser-diode array 82 is identical with the imaging-head resolution. Instead of an array with individually controllable laser diodes at spaced pixel intervals, it is also possible, for example, to employ a single, continuously radiating laser with a scanning mirror and a switchable filter.

A laser-diode array 83 constructed and controlled in a manner like for the laser-diode array 82 may be disposed behind the transfer location above the substrate 81. The laser-diode array 83 uniformly smoothes and fixes, respectively, the printing ink transferred to the substrate 81 in accordance with the distribution of the printing ink on the substrate 81, without heating the substrate 81 directly.

Instead of the laser-diode array 82, it is also possible to employ one or more continuously operating lasers, such as carbon-dioxide lasers, for example, which, in a manner similar to that described in connection with the transfer cylinder 70, linearly irradiate the printing ink which has been transferred to the substrate 81. Due to the brief subjection of the substrates 81 to irradiation as they pass by, the printing ink is initially melted at the surface thereof, which is generally sufficient for the purpose of fixing, yet also prevents too much moisture from leaving the paper.

In all of the aforedescribed methods of heating, the laser wavelength and the composition of the printing ink can be matched to one another, so that the printing ink is heated with the maximum possible efficiency whereas the transfer cylinder and the paper, respectively, are heated as little as possible at that time. Consequently, the paper does not dry out.

We claim:

1. Method of transferring printing ink from an intermediate carrier to a printing-ink receiver, the method which comprises:

applying solid printing ink to said intermediate carrier such that the solid printing ink adheres in a granular state to the intermediate carrier;

melting the solid printing ink substantially only at a side of the printing ink facing away from the intermediate carrier by using a heat source disposed outside the intermediate carrier; and subsequently transferring the solid printing ink to said printing-ink receiver selected from the group consisting of a further intermediate carrier and a substrate.

2. Method of transferring printing ink from said intermediate carrier to a printing-ink receiver, the method which comprises:

providing an intermediate carrier with an outer elastic layer containing an ink-repelling, liquid separating agent;

applying printing ink in an at least partially liquid state to the intermediate carrier;

driving the ink-repelling, liquid separating agent to a surface of the outer elastic layer and supplying the ink-repelling, liquid separating agent between the intermediate carrier and printing ink by pressing the intermediate carrier and said printing-ink receiver against one another, the printing-ink receiver being selected from the group consisting of a further intermediate carrier and a substrate; and reducing an adhesion of the printing ink to the intermediate carrier with the ink-repelling, liquid separating agent at one time at least before and during a transfer to the printing-ink receiver.

3. Device for transferring printing ink, comprising:

an intermediate carrier having an exterior surface;

an inking unit adjoining said intermediate carrier and transferring solid printing ink in a granular state from said inking unit to said intermediate carrier;

a printing ink receiver selected from the group consisting of a further intermediate carrier and a substrate, said printing ink receiver adjoining said intermediate carrier for receiving the printing ink from said intermediate carrier;

at least one laser device disposed distally outside said exterior surface of said intermediate carrier for concentrating radiation on one of said intermediate carrier and said printing-ink receiver, said at least one laser device melting directly, with the radiation, the printing-ink substantially only at a side of the printing-ink facing away from said intermediate carrier before transferring the solid printing ink to said printing-ink receiver, the solid printing-ink adhering to said intermediate carrier in a granular state, said exterior surface extending between said inking unit and said printing-ink receiver; and a control device connected to said at least one laser device for generating control signals, said control signals corresponding to a distribution of the printing-ink on said printing-ink receiver.

4. The device according to claim 3, wherein said at least one laser device is a laser.

5. The device according to claim 3, wherein said at least one laser device is an array of lasers.

6. The device according to claim 3, wherein said at least one laser device is an array of laser diodes.

7. Device for transferring printing ink from an inking unit of a printing press to a substrate being transported through the printing press, comprising:

a first intermediate carrier having a porous jacket permeable to an ink-repelling, liquid separating agent;

said inking unit adjoining said first intermediate carrier and transferring printing ink in a granular state from said inking unit onto said porous jacket of said first intermediate carrier;

a second intermediate carrier adjoining said first intermediate carrier and transferring the printing ink from said first intermediate carrier to said second intermediate carrier, said second intermediate carrier having an outer elastic layer storing the ink-repelling, liquid separating agent;

a printing ink receiver selected from the group consisting of a further intermediate carrier and a substrate, said printing ink receiver adjoining said second intermediate carrier for receiving the printing ink from said second intermediate carrier;

a first heat source disposed between said inking unit and said second intermediate carrier and opposite said first intermediate carrier; and a second heat source disposed opposite said second intermediate carrier.

8. Printing press, comprising:

a plurality of inking units;

a plurality of first intermediate carriers;

a second intermediate carrier, each of said first intermediate carriers, respectively, adjoining one of said inking units and said second intermediate carrier, said second intermediate carrier adjoining all of said first intermediate carriers and a substrate transported through the printing press; and a plurality of heat sources melting solid printing-ink substantially only at a side of the printing-ink facing away from said respective first intermediate carriers and said second intermediate carrier, the solid printing-ink adhering in a granular state to said first intermediate carriers, said heat sources disposed opposite respective surfaces of said first intermediate carriers and said second intermediate carrier, said surfaces of said first intermediate carriers, respectively, extending between said inking units and said second intermediate carrier, and said surface of said second intermediate carrier extending between at least one of said first intermediate carriers and the substrate.

9. Printing press, comprising:

a plurality of inking units;

a plurality of first intermediate carriers;

a second intermediate carrier, each of said first intermediate carriers, respectively, adjoining one of said inking units and said second intermediate carrier, said second intermediate carrier adjoining all of said first intermediate carriers and a substrate transported through the printing press, said second intermediate carrier being permeable to an ink-repelling, liquid separating agent at a side of said second intermediate carrier facing a printing ink disposed on said second intermediate carrier;

a plurality of heat sources for melting the printing-ink substantially only at a side of the printing-ink facing away from said respective first intermediate carriers, the printing-ink adhering in a granular state to said first intermediate carriers, said plurality of heat sources, respectively, disposed distally outside said first intermediate carriers and opposite to surfaces of said first intermediate carriers, said surfaces of said first intermediate carriers, respectively, extending between said inking units and said second intermediate carrier.

10. Printing press, comprising:

a plurality of inking units;

a first intermediate carrier;

a second intermediate carrier, each of said plurality of inking units adjoining said first intermediate carrier and said second intermediate carrier, said second intermediate carrier adjoining said first intermediate carrier and a substrate transported through the printing press;

a first heat source melting solid printing-ink substantially only at a side of the printing-ink facing away from said first intermediate carrier, the printing-ink adhering in a granular state to said first intermediate carrier, said first heat source disposed opposite a surface of said first intermediate carrier; and a second heat source disposed opposite a surface of said second intermediate carrier, said surface of said first intermediate carrier extending between one of said inking units and said second intermediate carrier, and said surface of said second intermediate carrier extending between said first intermediate carrier and the substrate.

11. Printing press, comprising:

a plurality of inking units;

a first intermediate carrier; and a second intermediate carrier, each of said plurality of inking units adjoining said first intermediate carrier and said second intermediate carrier, said second intermediate carrier adjoining said first intermediate carrier and a substrate transported through the printing press for transferring printing-ink from said first intermediate carrier to said second intermediate carrier, the printing-ink adhering in a granular state to said first intermediate carrier, said first intermediate carrier having at least one property selected from the group consisting of permeability to an ink-repelling, liquid separating agent and a storage capacity for the ink-repelling, liquid separating agent, and said second intermediate carrier being permeable to the ink-repelling, liquid separating agent at a side of said second intermediate carrier facing a printing ink disposed on said second intermediate carrier.

12. Device according to claim 11, wherein said second intermediate carrier adjoining the substrate has an outer elastic layer containing the ink-repelling, liquid separating agent therein.

13. Device according to claim 11, wherein the ink-repelling liquid separating agent is silicone oil.

* * * * *